US005220693A

United States Patent [19]

Paglia

[11] Patent Number: 5,220,693

[45] Date of Patent: Jun. 22, 1993

[54] TOILET SEAT POSITIONER

[76] Inventor: John Paglia, 1680 Narcissa Rd., Blue Bell, Pa. 19422

[21] Appl. No.: 815,512

[22] Filed: Jan. 2, 1992

[51] Int. Cl.[5] ..... A47K 13/10

[52] U.S. Cl. ..... 4/246.1; 16/110 R; 16/114 R

[58] Field of Search ..... 4/246.1; 16/110 R, 114 R

[56] References Cited

U.S. PATENT DOCUMENTS

| | | | |
|---|---|---|---|
| 2,236,576 | 4/1941 | Loebner | 4/246.1 |
| 3,191,193 | 6/1965 | Bogenberger | 4/251 |
| 3,314,746 | 4/1967 | Millar | 16/110 R X |
| 3,717,884 | 2/1973 | Manthooth | 4/251 |
| 3,783,455 | 1/1974 | Vanderbrook | 4/246.1 X |
| 4,129,907 | 12/1978 | Vaughan et al. | 4/251 |
| 4,574,401 | 3/1986 | Nakajima | 4/251 |
| 4,736,471 | 4/1988 | Johnson | 4/234 |
| 4,783,419 | 3/1988 | Nee | 4/661 |
| 4,805,246 | 2/1989 | De Vargas et al. | 4/251 |
| 4,843,656 | 7/1989 | Forman | 4/251 |
| 4,850,062 | 7/1989 | Gibson et al. | 4/251 |
| 5,065,460 | 11/1991 | Currin | 4/246.1 X |

*Primary Examiner*—Charles E. Phillips

[57] ABSTRACT

A toil seat positioner 34 attachable to the underside of a toilet seat for the purpose of manually positioning the toilet seat in a sanitary manner. The positioner's base structure 30 with shaft 48 facilitates coupling of the grasping portion 34 for rotational or fixed positions. The interchangeability of manufactured grasping portions 34 allow for a plurality of grasping portions. Additionally, any desired object not limited by size or weight can become a changeable grasping portion by employing the grasping portion adapter 60, or become a permanent grasping portion by securing directly to the shaft 48.

16 Claims, 4 Drawing Sheets

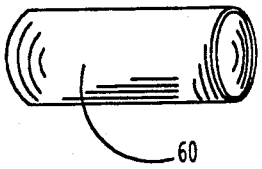
Fig.6A
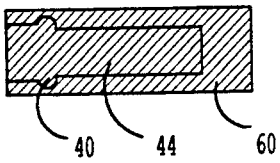
Fig.6B
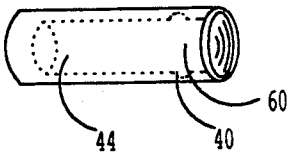
Fig.6C
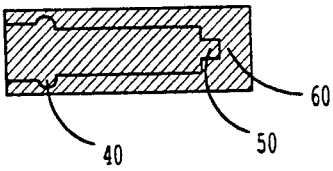
Fig.6D
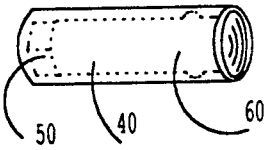
Fig.6E
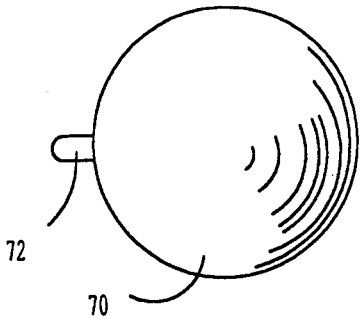
Fig.7A
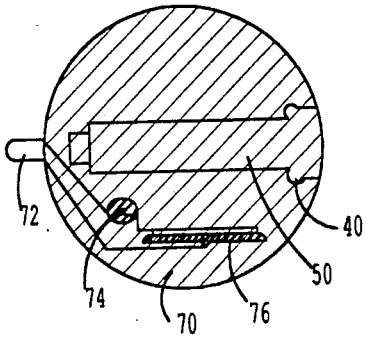
Fig.7B
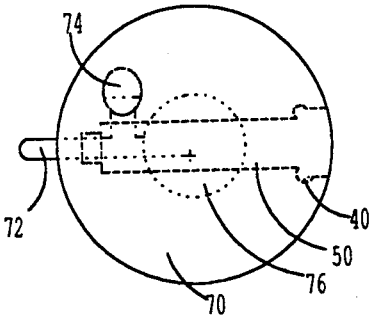
Fig.7C
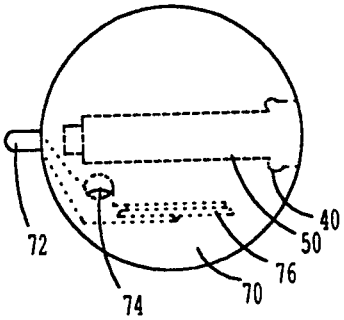
Fig.7D
Fig.8A
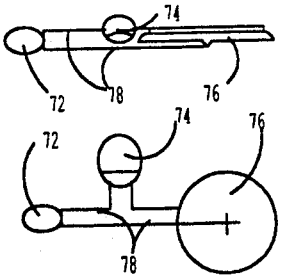
Fig.8B
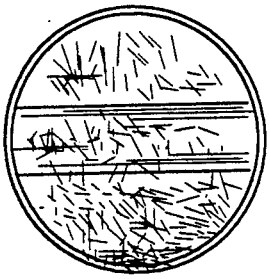
Fig.9

TOILET SEAT POSITIONER

BACKGROUND

1. Field of the Invention

This invention relates to toilet seats, specifically to an improved toilet seat positioner which provides a choice of grasping portions while still maintaining a sanitary means of raising and lowering the seat.

BACKGROUND

2. Cross-Reference to Related Applications

Three design patent applications for toilet seat positioners have been filed for, by me, on the following dates;

Nov. 18, 1991, #07/793210, Toilet Seat Positioner

Dec. 6, 1991, #07/802778 Toilet Seat Positioner

Dec. 6, 1991, #07/803396, Toilet Seat with Integrated Positioner

BACKGROUND

3. Discussion of Prior Art

Heretofore toilet seat positioners were concerned primarily with hygiene; protecting the users fingers from contacting the bottom of the toilet seat and the rim of the toilet bowl. The prior art has failed to adequately take into consideration the decorative, aesthetic, and novel value of a toilet seat positioner. The basic functional aspect of the positioner has been addressed in prior art but its ornamental value as a bathroom fixture has been overlooked; thereby explaining why the toilet seat positioner has not gained general acceptance even though an obviously unsanitary condition would be corrected by its use.

Nakajima, U.S. Pat. No. 4,574,401, 1986, has a removable handle as does Vaughan et al., U.S. Pat. No. 4,129,907, 1978, but neither for the purpose of creating decorative or aesthetic options; Nakajima to install a cover and Vaughan for cleaning.

OBJECTS AND ADVANTAGES

It is an object of this invention to provide an improved toilet seat positioner, one that gives decorative, aesthetic, and novel options while continuing to provide the user with a clean and hygienic means of positioning the toilet seat.

Another object of this invention is to provide a sanitary toilet seat positioner which is simple in construction, economical to manufacture, affording convenient changeability and coupling of the grasping portion without the need of hand tools.

Another object of this invention is to allow the implementation of an almost unlimited array of objects, be they personal, sentimental, or novel, to be used as the grasping portion of the toilet seat positioner.

Another object of this invention is to allow the grasping portion to incorporate in its structure various utilitarian and novel devices which will add practical and amusement value to the toilet seat positioner.

With the above and other objects in view, the present invention consists of the combination and arrangement of parts herein more fully described, and illustrated in the accompanying drawings, and more particularly, that changes may be made in the form, size, proportions, and minor details of construction without departing from the spirit or sacrificing any of the advantages of the invention.

BRIEF DESCRIPTION OF THE DRAWINGS

In the drawings, closely related figures have the same number but different alphabetic suffixes;

FIGS. 6A to 6E show elevated, isometric, transverse, sectional, and hidden line views of alternate embodiments of a grasping portion adapter;

FIGS. 7A to 7D show elevated, transverse, sectional, with hidden line views, of an alternate embodiment of a grasping portion housing a warning light.

FIGS. 8A and 8B illustrate schematically, an electric circuit encased in grasping portion with warning light shown in FIGS. 7A to 7D;

FIG. 9 shows an elevated, transverse view of an alternate embodiment of grasping portion housing floating particles;

DESCRIPTION

Figure 1:
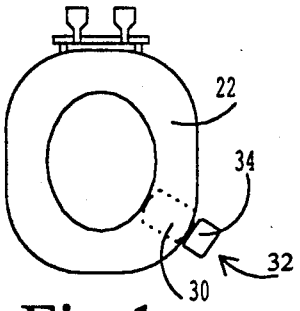
FIG. 1 is a top plan view, with hidden lines, of a toilet seat positioner in combination with a toilet seat.
Figure 2:
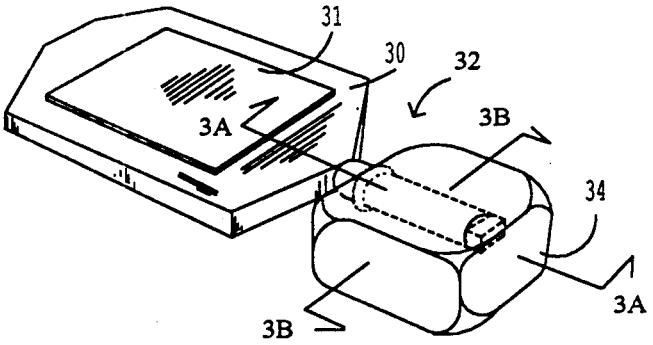
FIG. 2 is an isometric view, with hidden lines, of the toilet seat positioner.
Figure 3A:
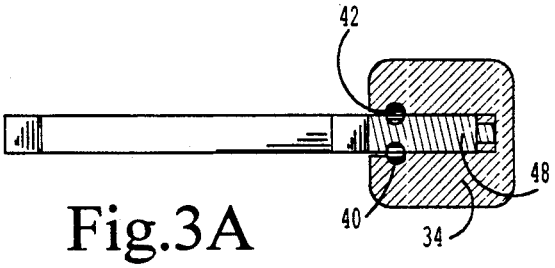
FIG. 3A is a partial, sectional, elevated, transverse view taken along the section lines of 3A—3A in FIG. 2 of the toilet seat positioner.
Figure 3B:
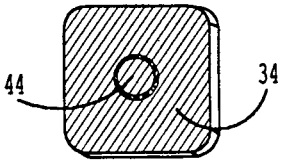
FIG. 3B is a sectional, isometric view taken along the section lines of 3B—3B in FIG. 2 of the grasping portion.
Figure 4A:
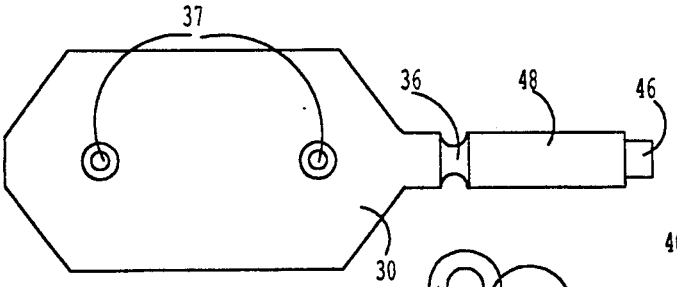
FIG. 4A is a top plan view of a base structure with a shaft.
Figure 4B:
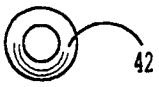
FIG. 4B is a top plan view of an annular flexible retainer.
Figure 4C:
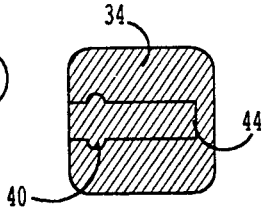
FIG. 4C is a sectional, elevated, transverse view taken along the section lines of 3A—3A in FIG. 2 of the grasping portion.

Now with particular reference to the drawings, FIG. 1 is a typical toilet seat 22 with a toilet seat positioner 32 attached to one side. The positioner can be attached to either or both sides of the seat. FIG. 2 shows a toilet seat positioner, base structure 30, being planar, with a modified rectangle shape, terminating in a shaft 48 with a square spline 46. The base structure and shaft may be constructed of any acceptable material, such as wood, plastic, or metal. FIG. 2 shows a grasping portion 34 as a modified square, or cube shape.

FIGS. 3A, 3B, 4A, 4B, and 4C show a sectional view of the base structure 30 and shaft 48. A square spline 46, a retaining ring 42, and a retaining ring groove 36 around the shaft make up the complete shaft. Also shown is a cube shaped grasping portion 34 with a smooth bore 44. The smooth bore allows free rotation of the grasping portion. An annular groove 40 in the smooth bore allows the grasping portion to be retained on the shaft when the retaining ring is in place. The grasping portion bore is sized incrementally to accommodate the shaft 48. The annular groove 40 in the bore engages the retaining ring 42 when the grasping portion girdles the shaft 48.

An adhesive 31 and mechanical fastener holes 37 are shown. The adhesive surface of the base structure 30 is attached to the underside of the toilet seat. In addition a further mechanical fastening is often desirable. A screw connection, preferable a flat head screw, with a taper corresponding to the beveled edges of the screw holes 37 can be used.

Figure 5A:
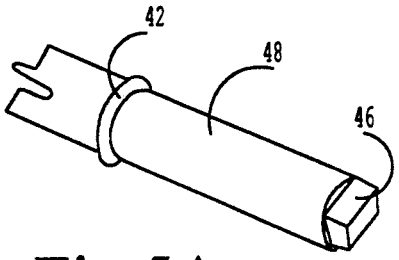
FIG. 5A is an isometric partial view of the shaft.
Figure 5B:
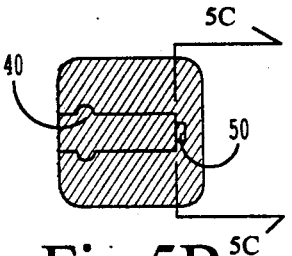
FIG. 5B is a sectional, elevated, transverse view taken along the section lines of 3A—3A in FIG. 2 of an alternate embodiment of grasping portion.
Figure 5C:
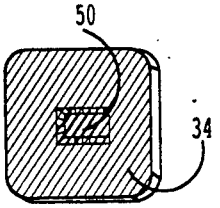
FIG. 5C is a sectional, isometric, view taken along the section lines of 5C—5C in FIG. 5B of an alternate embodiment of the grasping portion.

FIGS. 5A, 5B, 5C, show the shaft 48 with retaining ring 42, and square spline 46. The grasping portion 34 in these views has a spline bore 50 thus allowing for a fixed position of the grasping portion when coupled to the shaft. The fixed position being desirable in certain embodiments of this invention.

FIGS. 6A to 6E show an alternate embodiment of this invention. The grasping portion 34 in this embodiment is a small diameter round rod shaped portion with both smooth 44 and spline 50 bores to allow both free rotation and fixed position, when connected to the shaft. In addition to being a grasping portion this, now called a grasping portion adapter 60, will allow an unlimited number of objects to be interchangeably used as grasping portions simply by drilling a hole in an object and inserting the grasping portion adapter with some form of adhesive on it into the drilled hole. The only limitations on the object to be used as a grasping portion are size, and weight. Also, any object desired as a permanent grasping element can be permanently coupled to the base structure 30 shaft 48 by boring a hole in the object the same size as the outside diameter of the shaft. Then applying adhesive to the coupler shaft, and sliding the desired object onto the shaft.

FIGS. 7A to 7D show another embodiment of the invention. A grasping portion with warning light 70 is shown as a sphere, but can take any acceptable shape. A spline bore 50 is used with this embodiment because of the necessity to maintain fixed positions needed for proper operation of a mercury switch 74. When the toilet seat is in the horizontal, down position, the mercury switch 74 is in the non-conducting position and the L. E . D., 72 is off. When the toilet seat is raised to the vertical, up position, the mercury switch 74 is in the conducting position and the L.E.D. 72 is on. The person using the toilet is now being warned to return the toilet seat to the horizontal position when finished. But if the seat is inadvertently left in the vertical position with the L.E.D., 72 on, it still serves as a warning to the next person using the toilet. In the dark the light is visible and can prevent someone from accidentally sitting on the toilet bowl rim. FIG. 7C shows the mercury switch in a conducting position. A wafer battery 76 and L.E.D. 72 are also shown. FIGS. 7B and 7D show the grasping portion with warning light, the mercury switch being in the non-conducting position.

FIGS. 8A and 8B show an electric circuit schematically, a L.E.D. 72, a mercury switch 74, a wafer battery 76, and conducting connections 78. The elements of this embodiment are permanently encased in molded plastic.

FIG. 9 shows another embodiment of the invention in the form of a sphere, but need not be limited to such shape, which contains a liquid with free floating particles. The elements of this embodiment are encased in plastic.

Figure 10A:
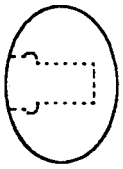
FIGS. 10A and 10B show a top and transverse plan with hidden line views of an oval, or egged shape grasping portion.
Figure 10B:
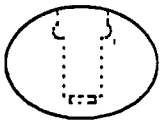
Figure 10C:
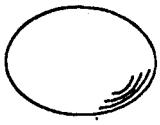
FIG. 10C shows an elevated, transverse view of oval shape.
Figure 11A:
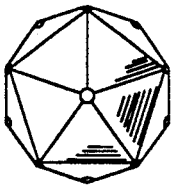
FIGS. 11A and 11B show a top plan and transverse elevation of a modified geodesic shaped grasping portion.
Figure 11B:
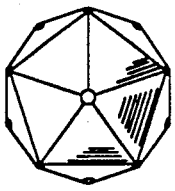
Figure 12A:
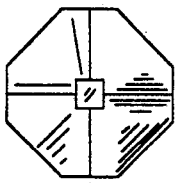
FIGS. 12A and 12B show a top plan and transverse elevation of a modified diamond shaped grasping portion.
Figure 12B:
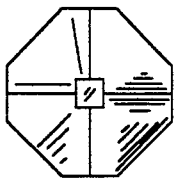
Figure 13A:
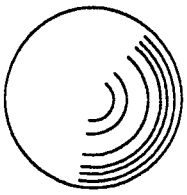
FIGS. 13A shows a front elevation, 13B a transverse elevation, 13C an isometric view of a half sphere of a grasping portion.
Figure 13B:
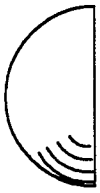
Figure 13C:
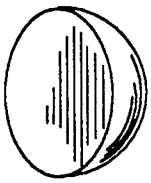
Figure 14A:
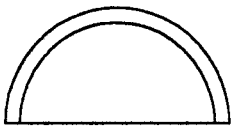
FIGS. 14A shows a top plan, 14B a transverse elevation, 14C a front elevation of an attached double half circle of a grasping portion.
Figure 14B:
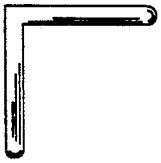
Figure 14C:
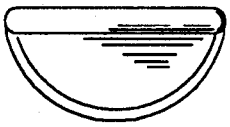
Figure 15A:
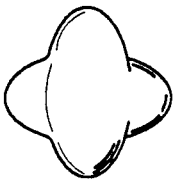
FIGS. 15A and 15B show a front and transverse elevation of two ovals intersecting to form grasping portion.
Figure 15B:
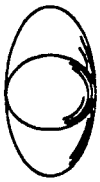
Figure 17A:
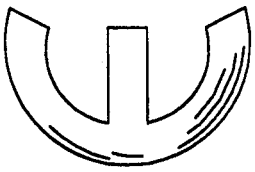
FIGS. 17A shows a top plan, 17B a rear elevation, and 17C a front elevation of a bowed round rod intersected in the middle with a straight round rod.
Figure 16A:
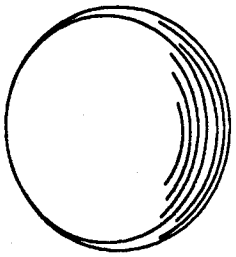
FIGS. 16A and 16B show isometric and transverse elevation of a round edged disc, grasping portion.
Figure 16B:
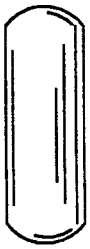
Figure 17B:
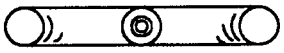
Figure 17C:
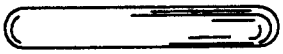
Figure 18A:
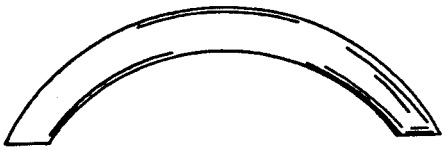
FIGS. 18A shows a top plan, 18B a rear elevation, and 18C a front elevation of a bowed round rod.
Figure 19A:
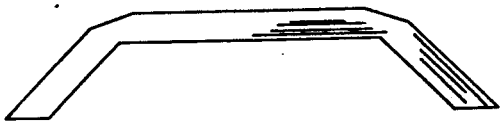
FIGS. 19A shows a top plan, 19B an isometric view of a bowed angled rail.
Figure 18B:
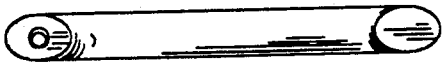
Figure 19B:
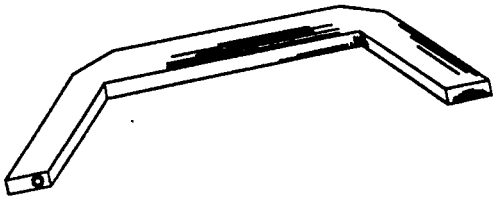
Figure 18C:
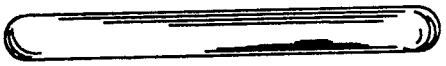

FIGS. 10A to 10C show an alternate shaped embodiment with hidden lines of both smooth and spline bores.

FIGS. 11A to FIGS. 19B show alternate shaped embodiments. All of these embodiments can have either smooth or splined bores.

OPERATION

The base structure 30 of the toilet seat positioner 32 will permit attachment to the bottom of a toilet seat with either adhesive or mechanical fastening method. The coupling action of the shaft 48 and the grasping position 34 is accomplished by sliding the grasping portion 34 onto the shaft 48 until the shaft's 48 retaining ring 42 is engaged by the annular grove 40 in the grasping portion's 34 bore. Once the shaft's 48 retaining ring 42 has meshed with the grasping portion's annular grove 40 the grasping portion is now held in place on the shaft. The shaft 48 will allow immediate coupling of the grasping portion 34, and if the grasping portion has a smooth bore 44, free rotation, since the spline on the shaft is by-passed If the grasping portion has a spline bore 50, the spline on the shaft will be utilized when coupled and the grasping portion will maintain a fixed position. Thus the interchangeability, position, and coupling of the grasping portion is assured.

With the grasping portion adapter 60 embodiment, FIGS. 6A to 6E, an infinite number of optional objects may be employed as grasping elements. A hole drilled the size of the outside diameter of the grasping portion adapter and an adhesive is all that is necessary to convert an object into a readily exchangeable grasping portion 34.

Additionally, any object not limited by size or weight can be permanently coupled to the shaft 48 by drilling the object with a hole the size of the outside diameter of the shaft, coating the shaft with adhesive, and sliding the object onto the shaft. Also the shaft itself can be used as a grasping portion if desired.

The grasping portion with warning light 70 embodiment serves as a warning light when the seat is left in an up, vertical, position, thereby preventing someone from accidentally sitting on the toilet bowl rim. The mercury switch 74 energizes the L.E.D. 72 from the wafer battery 76, through the conducting circuit 78, in this vertical position, FIG. 8B. When the seat is lowered, to horizontal, the conducting circuit is de-energized and the L.E.D. goes out, FIG. 8A. The mercury switch is now in the non-conducting position. This embodiment is replaceable with a new unit when the battery dissipates.

In the embodiment of the grasping portion, housing floating particles, the particles will be stationary with no movement of the toilet seat positioner and toilet seat. When the toilet seat is moved the particles will be disturbed and become suspended in the liquid; slowly settling as time passes, thus creating a novel effect. Either a smooth or spine bore can be used with this embodiment. Additionally the depiction of any object, whether by a miniature replication, a picture, or symbol of such object, can be encased in clear plastic of any desired shape.

SUMMARY, RAMIFICATIONS, AND SCOPE

The toilet seat positioner allows a multitude of available grasping portions to be used in combination with a toilet and toilet seat. The grasping portion can take the form of decorative, aesthetic, novel, amusement, or utilitarian purpose when used in combination with the base structure and shaft.

Although the description above contains many specifics these should not be construed as limiting the scope of the invention but merely providing illustrations of some of the presently preferred embodiments of this invention. For example a small transistor radio could become a grasping portion, as could a smoke alarm An object such as a golf ball that has acquired novel value could be mounted. As could a miniature fire hydrant replication be mounted by a firefighter to add novelty to the bathroom decor.

Thus the scope of the invention should be determined by the appended claims and their legal equivalents, rather than by the examples given.

The embodiments of the invention in which an exclusive property or privilege is claimed are defined as follows:

1. A toilet seat positioner for attachment to a toilet seat undersurface comprising:

a generally planar base structure having a shaft extending in a cantilevered manner from a periphery of said base structure, a means for attaching said base structure to said toilet seat undersurface, a grasping portion having a bore to accept said shaft in a cooperative fit so as to maintain their relative positions, said grasping portion having a light assembly encased therein, said light assembly including a battery connected to said light source, by a gravity operated switch, and a conducting circuit such that with said grasping portion, bore accepted on said shaft with the toilet seat in a down position said switch will interrupt the battery connection to the light source and with the seat in an up position the battery will be connected through said switch to said light such that a light visible to a user will be emitted.

2. The combination of claim 1 wherein said battery is a wafer type, said light source a light emitting diode, and said switching a mercury type.

3. The toilet seat positioner of claim 1 wherein said grasping portion comprising a translucent plastic encasement filled with a clear liquid and fragmented matter.

4. The toilet seat positioner of claim 1 wherein said grasping portion comprising a translucent plastic encasement with an object contained in said encasement.

5. The grasping portion of claim 1 wherein said grasping portion has a modified square of cube shape.

6. The grasping portion of claim 1 wherein said grasping portion has a spherical shape.

7. The grasping portion of claim 1 wherein said grasping portion has rounded egg shape.

8. The grasping portion of claim 1 wherein said grasping portion has a geodesic shape.

9. The grasping portion of claim 1 wherein said grasping portion has modified diamond shape.

10. The grasping portion of claim 1 wherein said grasping portion has a half sphere shape.

11. The grasping portion of claim 1 wherein said grasping portion has two planar half circles joined along their diameter edges at a 45 degree angle.

12. The grasping portion of claim 1 wherein said grasping portion has two oval shapes intersecting, with four equal portions or protrusions extending outward from said intersection.

13. The grasping portion of claim 1 wherein said grasping portion has a disc shape.

14. The grasping portion of claim 1 wherein said grasping portion is a bowed rod intersected in the center with a straight rod.

15. The grasping portion of claim 1 wherein said grasping portion is a bowed rod.

16. The grasping portion of claim 1 wherein said grasping portion is a bowed rod rail with a plurality of planar surfaces.

* * * * *